US011540677B1

(12) United States Patent
Donahue

(10) Patent No.: US 11,540,677 B1
(45) Date of Patent: Jan. 3, 2023

(54) AUTOMATED TOILET LID AND TOILET SEAT ACTUATING SYSTEM

(71) Applicant: Larry David Donahue, Asheville, NC (US)

(72) Inventor: Larry David Donahue, Asheville, NC (US)

( * ) Notice: Subject to any disclaimer, the term of this patent is extended or adjusted under 35 U.S.C. 154(b) by 0 days.

(21) Appl. No.: 17/852,775

(22) Filed: Jun. 29, 2022

Related U.S. Application Data

(60) Provisional application No. 63/233,244, filed on Aug. 14, 2021.

(51) Int. Cl.
*A47K 13/10* (2006.01)
*H01F 7/16* (2006.01)
*H01F 7/08* (2006.01)

(52) U.S. Cl.
CPC ..... *A47K 13/10* (2013.01); *H01F 7/081* (2013.01); *H01F 7/16* (2013.01)

(58) Field of Classification Search
CPC ..... A47K 13/10
USPC ..... 4/246.1
See application file for complete search history.

(56) References Cited

U.S. PATENT DOCUMENTS 5,867,843 A * 2/1999 Robello ..... A47K 13/10 4/246.1
9,532,686 B1 * 1/2017 Heiss ..... A47K 13/10
2010/0299819 A1 * 12/2010 Huang ..... A47K 13/10 4/244.2

* cited by examiner

*Primary Examiner* — Christine J Skubinna

(57) ABSTRACT

The present invention is an automated toilet lid and toilet seat actuating system for toilets that enables the user to raise and lower a toilet lid and toilet seat by electrical switches, remote control, voice command or motion sensors incorporating a horizontal mounted linear actuator, an electromagnet attached to a toilet lid or toilet seat, a piece of ferrous metal attached to a toilet lid or toilet seat, a toilet lid bracket with a bore of different diameters mounted to a toilet lid, an adapter rod of different diameters, a removable lid bracket cap, an electronic control with off delay timer circuit and a power supply or battery. The removal of the lid bracket cap from the toilet lid bracket facilitates the manual operation of the toilet lid and toilet seat.

4 Claims, 7 Drawing Sheets

AUTOMATED TOILET LID AND TOILET SEAT ACTUATING SYSTEM

This application claims the benefit of U.S. Provisional Application No. 63/233,244 filed on Aug. 14, 2021 and entitled "AUTOMATED TOILET LID AND TOILET SEAT ACTUATING SYSTEM."

BACKGROUND OF THE INVENTION

The present invention relates to the raising and lowering of a toilet lid and toilet seat by electromechanical, or other, means thus eliminating the raising and lowering of a toilet lid and toilet seat by hand.

A number of systems have been developed for the automated raising and lowering of toilet lids and toilet seats as in the following examples, U.S. Pat. Nos. 6,643,852, 5,307,524, 7,788,741, 8,910,320 and 10,791,888.

These earlier designs incorporated multiple motors, multiple gear assemblies, multiple clutching mechanisms, multiple counterbalance springs, motion sensors as well as various other approaches both electrical and mechanical none of which resulted in an affordable automated toilet lid and toilet seat raising and lowering system. These earlier designs also located their lifting points of attachment at, or behind, the toilet lid and toilet seat hinges which put their lifting mechanisms at a severe mechanical disadvantage.

SUMMARY OF THE INVENTION

The aforementioned issues are overcome by the present invention making an affordable automated toilet lid and toilet seat raising and lowering system possible by using one linear actuator, one electromagnet, one piece of ferrous metal, an electronic controller with off delay timer circuit and a bracket mounted to a toilet lid with removable cap that, when removed, disengages said lifting system making it possible to raise and lower a toilet lid and toilet seat manually without the use of clutching mechanisms.

The present invention also locates it's toilet lid and toilet seat lifting points of attachment forward of the toilet lid and toilet seat hinges giving the present invention a greater mechanical advantage over previous designs that require counterbalance springs to help compensate for their mechanical disadvantage.

The present invention raises and lowers a toilet lid by means of a horizontal mounted linear actuator. The present invention also raises and lowers a toilet lid and toilet seat together by the activation of both a horizontal mounted linear actuator and an electromagnet that is attached to a toilet lid or toilet seat whereas the electromagnet, when energized, electromagnetically affixes to a piece of ferrous metal attached to a toilet seat or toilet lid, and whereas the horizontal mounted linear actuator raises and lowers both the toilet lid and toilet seat together at the same time.

In the case of an electrical, mechanical, or other, failure, a lid mounted bracket with a removable cap, or moveable pin, leaver, or other like mechanisms to include, but not limited to, activation and deactivation by friction, facilitates the manual operation of the toilet lid and toilet seat with the present invention.

BRIEF DESCRIPTION OF THE DRAWINGS

FIG. 3 C is a rear view of a lid bracket cap 136 with it's slot that allows an actuating arm 112 to enter the lid bracket 132.

FIG. 3 D is a front view of the lid bracket cap 136 with it's solid face that prevents the actuating arm 112 from sliding forward through the lid bracket 132 when the lid bracket cap 136 is installed.

DETAILED DESCRIPTION OF THE EMBODIMENTS OF THE INVENTION

Figure 1:
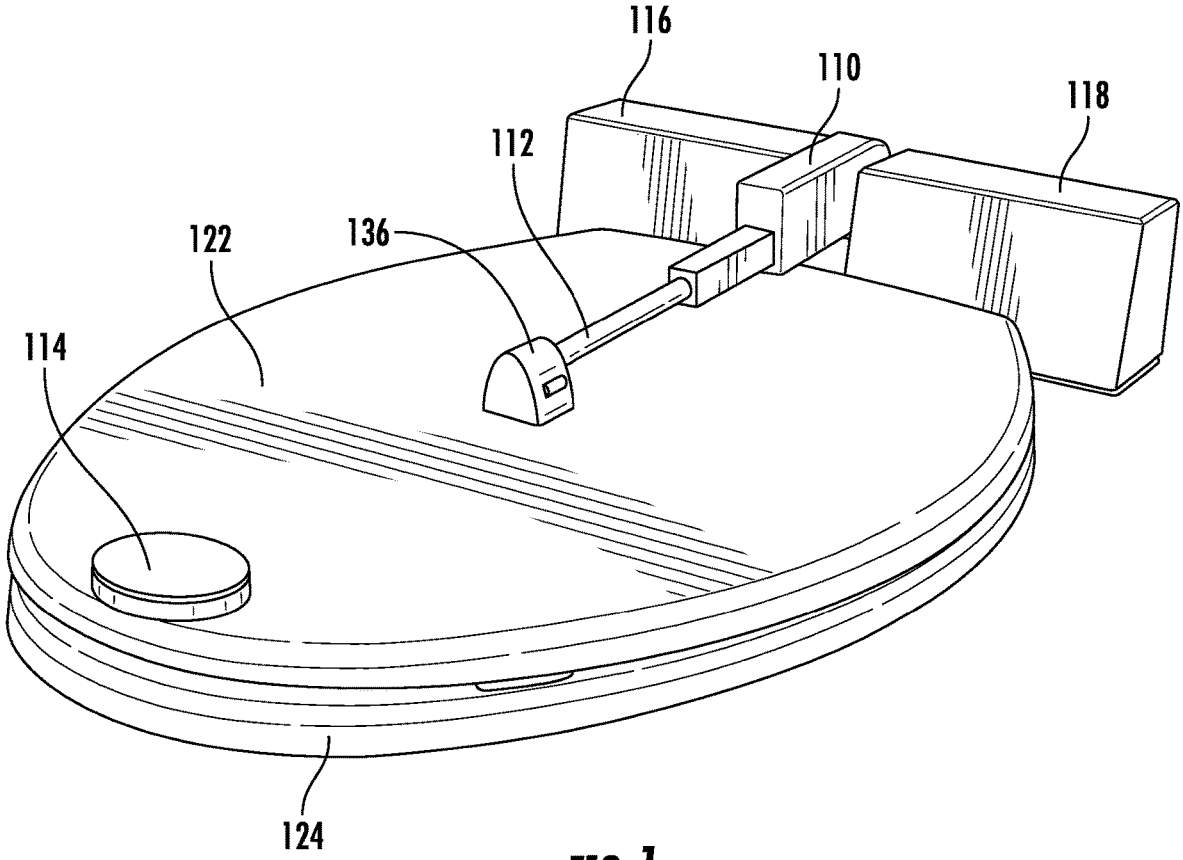
FIG. 1 is a perspective view of the present invention according to one embodiment.

One embodiment of the present invention is shown generally in FIG. 1. As illustrated, this embodiment includes a linear actuator 110, an actuating arm 112, a lid bracket cap 136, an electromagnet 114, an electronics control housing 116, a battery housing 118, a toilet lid 122 and a toilet seat 124.

In this embodiment, the toilet lid 122 is shown set for the automated raising and lowering of the toilet lid 122 by the linear actuator 110, with the lid bracket cap 136 installed. In addition, the toilet seat 124 will be raised and lowered along with the toilet lid 122 when an electronic control 138 energizes both the electromagnet 114 and the linear actuator 110.

Figure 2:
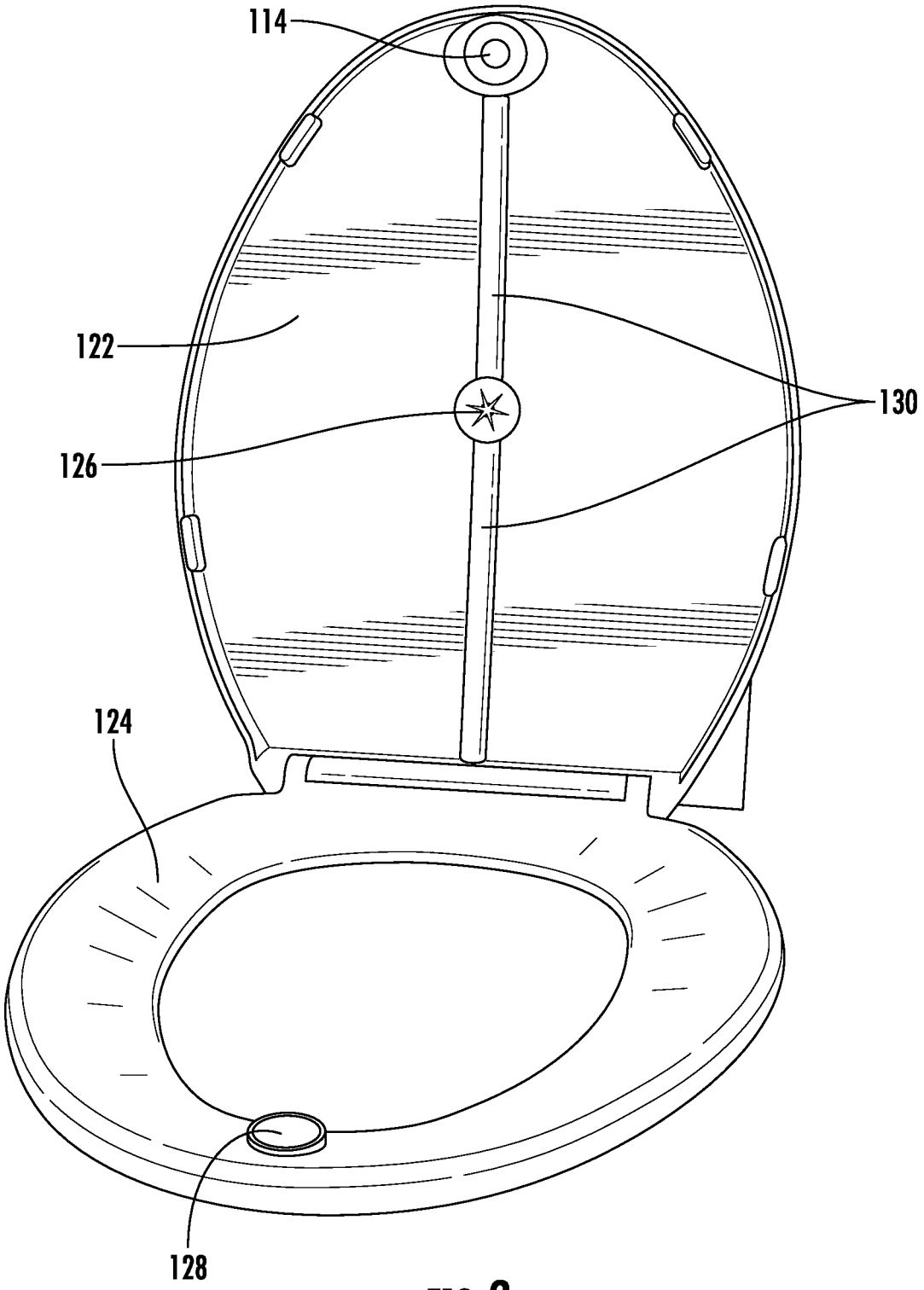
FIG. 2 is a perspective view showing a toilet lid 122 in a raised position.
Figure 3A:
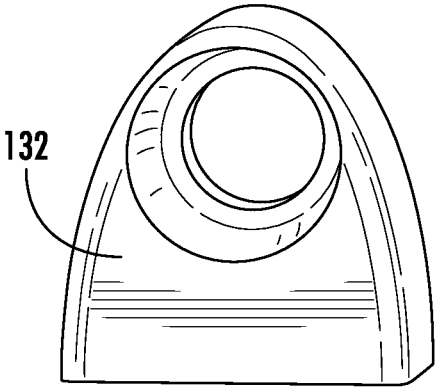
FIG. 3A is a front view of a lid bracket 132 showing it's bore of different diameters.
Figure 3B:
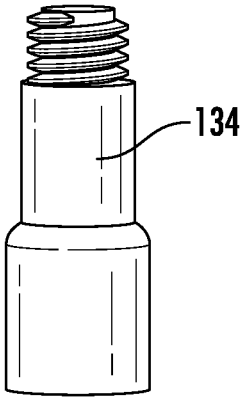
FIG. 3 B is a side view of an adapter rod 134 showing it's shaft of different diameters and threaded end.
Figure 3C:
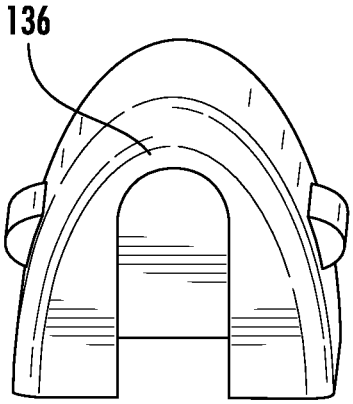
Figure 3D:
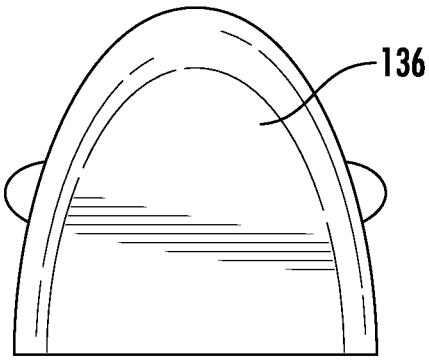

FIG. 2 illustrates an embodiment of the present invention, wherein the invention includes a piece of ferrous metal 128 that is mounted to the toilet seat 124. Attached to the toilet lid 122 is an LED (light-emitting diode) 126, the electromagnet 114 and two wire raceways 130 that supply current to the LED 126 and electromagnet 114. The wire raceways 130 can be surface mounted or internal on either the top or bottom of the toilet lid 122 or the toilet seat 124, or both.

The raising and lowering of the toilet lid 122 along with the toilet seat 124 is accomplished through energizing both the linear actuator 110 and the electromagnet 114. The LED 126 is illuminated during the raising of the toilet lid 122, or the raising of the toilet lid 122 and the toilet seat 124, and the LED 126 remains on until the lowering command is given by the electronic control 138 at which time the LED 126 is disabled. The LED can also be configured to remain on continuously. When the toilet lid 122, or the toilet lid 122 and the toilet seat 124, are in the fully raised or fully lowered position, the linear actuator 110 and the electromagnet 114 are disabled by the electronic control 138.

FIG. 3 A is a front view of a lid bracket 132 revealing it's bore of different diameters with the larger bore sized to accommodate the larger portion of an adapter rod 134, and the lid bracket's 132 smaller bore sized to allow the actuating arm 112 to slide forward through the lid bracket 132 thereby facilitating the manual operation of the toilet lid 122 and the toilet seat 124 when the lid bracket cap 136 is removed.

FIG. 3 B is a side view of the adapter rod 134 showing it's shaft of different diameters with a portion of the smaller diameter threaded at the end to mate with the actuating arm's 112 threaded bore. The smaller diameter of the adapter rod 134 is sized to slide forward through the lid bracket's 132 smaller bore for manual operation, and the adapter rod's 134 larger diameter sized to prevent the actuating arm 112 from sliding backward through the lid bracket's 132 smaller bore to facilitate the automated operation of said system.

FIG. 3 C is a rear view of the lid bracket cap 136 showing it's slot that allows the actuating arm 112 to enter the lid bracket 132. When the lid bracket cap 136 is installed on the lid bracket 132, the actuating arm 112 is prevented from sliding forward through the lid bracket 132 and in so, facilitates the automated operation of the toilet lid 122 and toilet seat 124 by the linear actuator 110. When the lid bracket cap 136 is removed, the manual raising and lowering of the toilet lid 122 and the toilet seat 124 is made possible by allowing the actuating arm 112 to slide forward through the lid bracket's 132 smaller bore.

FIG. 3 D is a front view of the lid bracket cap 136 showing it's solid face that, when installed on the lid bracket 132, prevents the actuating arm 112 from moving forward through the lid bracket 132 for the automated operation of said system.

Figure 4:
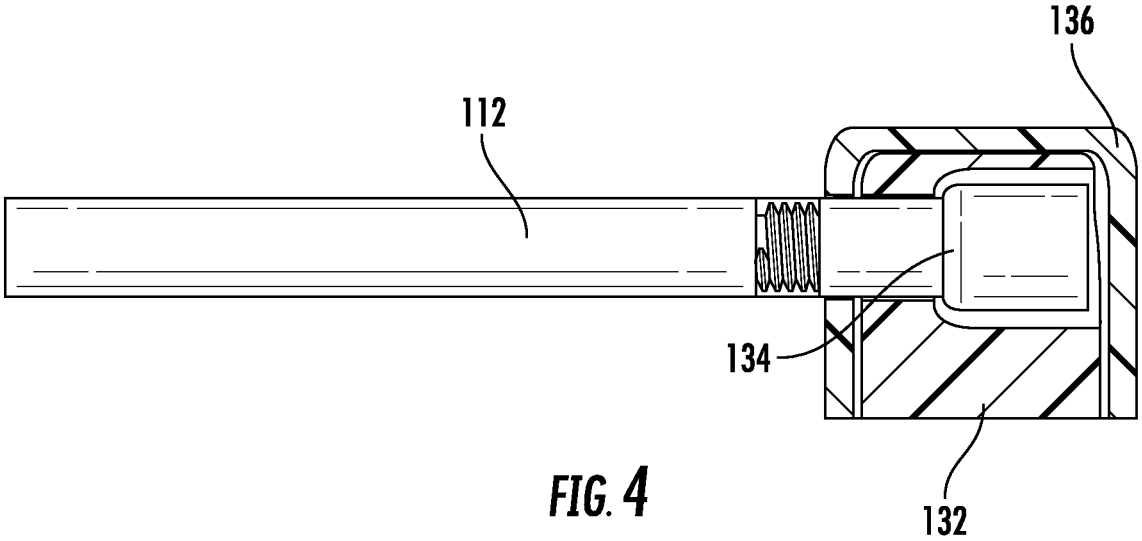
FIG. 4 is an assembled, cutaway view of the lid bracket 132 and lid bracket cap 136, with the lid bracket cap 136 installed on the lid bracket 132 and the adapter rod 134 screwed into the actuating arm 112.

FIG. 4 shows a cutaway of the lid bracket 132, the lid bracket cap 136, the adapter rod 134 and the actuating arm 112.

Figure 5:
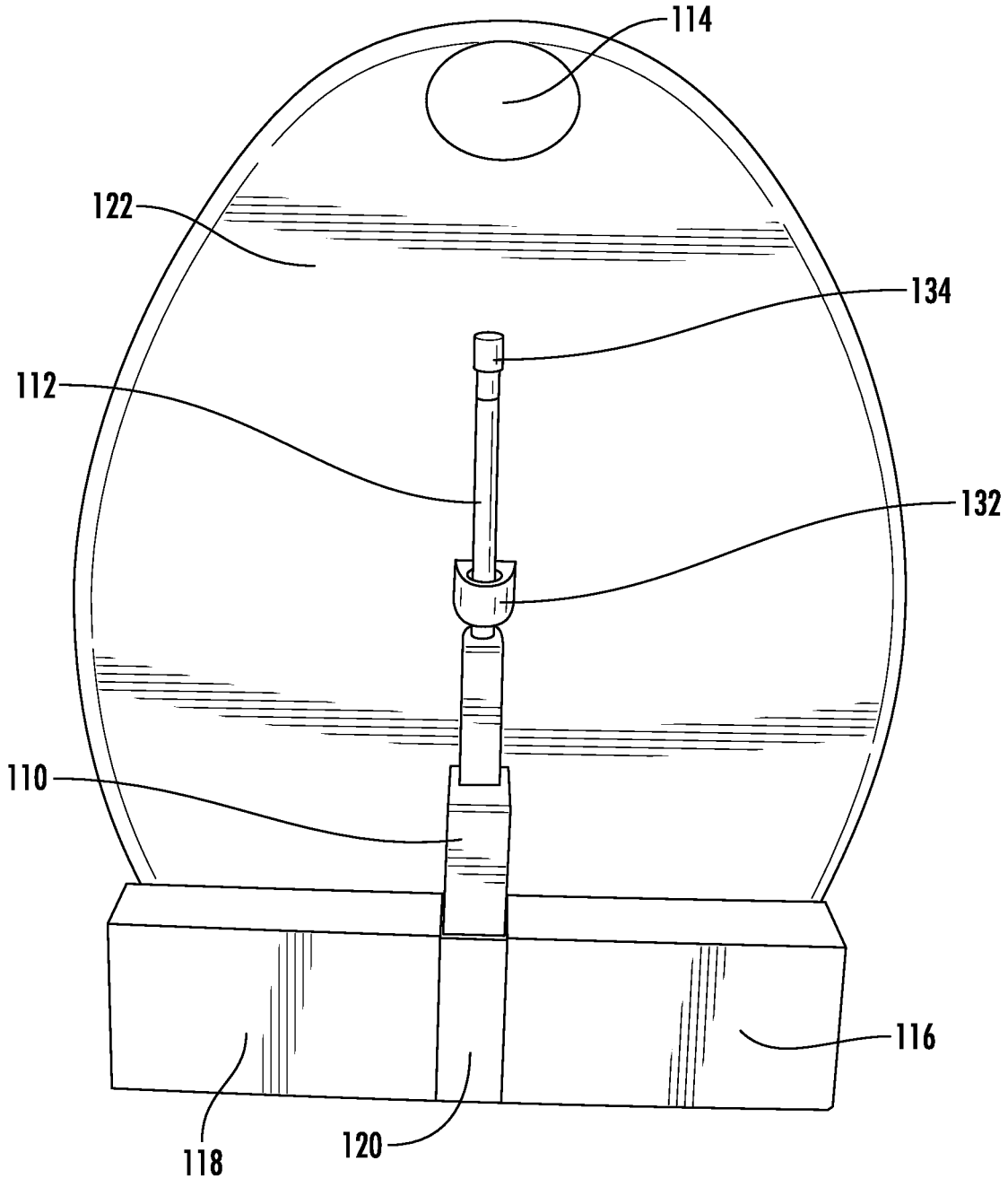
FIG. 5 is a rear view of the present invention showing the toilet lid 122 and a toilet seat 124 in their manually raised position with the lid bracket cap 136 removed.

FIG. 5 The present invention is show with the toilet lid 122 and toilet seat 124 in the manually raised position with the lid bracket cap 136 removed, thereby allowing the actuating arm 112 to slide forward through the lid bracket 132 for the manual operation of said system.

Figure 6:
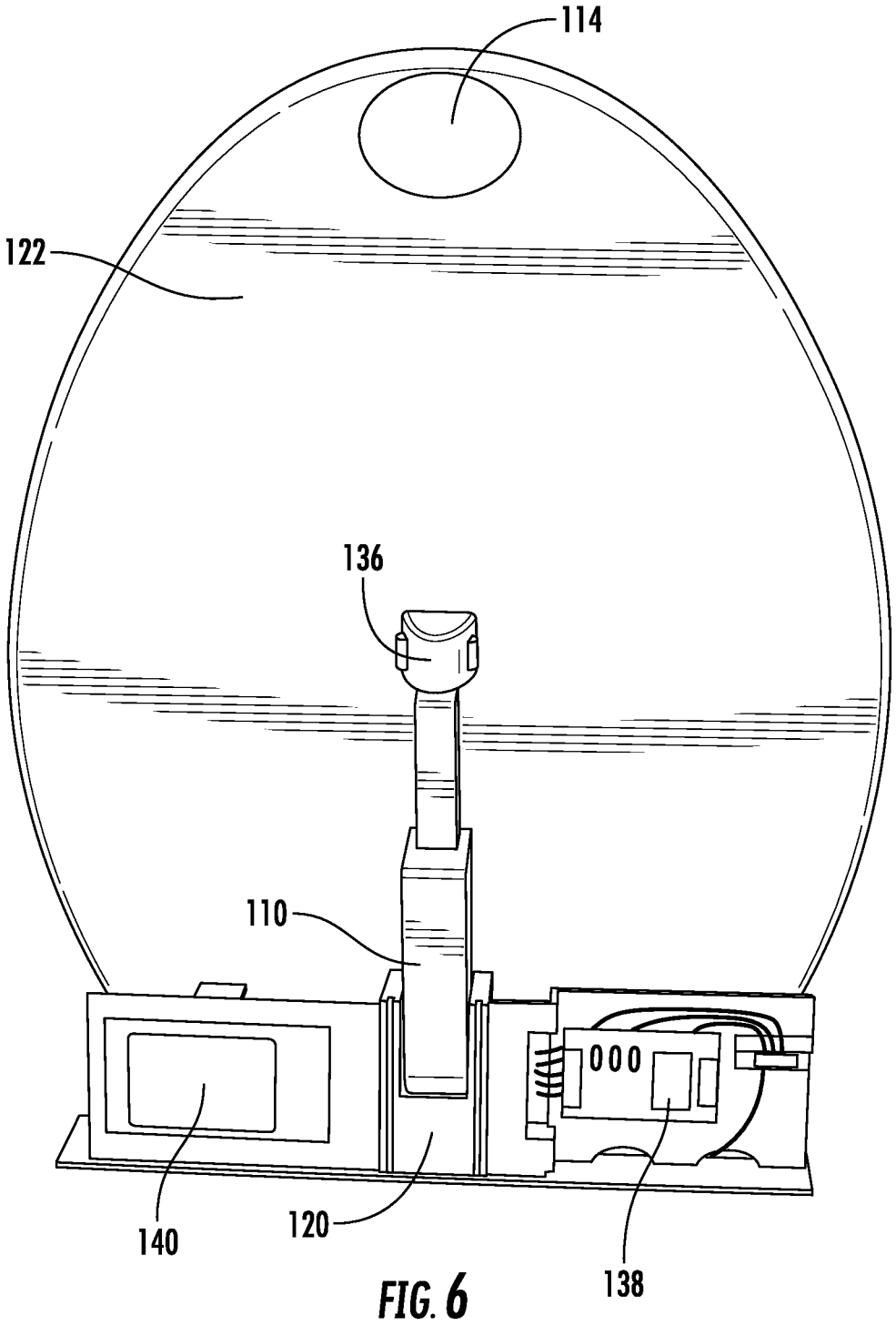
FIG. 6 is a rear view of the present invention showing the toilet lid 122 and the toilet seat 124 in their automated raised position with the lid bracket cap 136 installed.

FIG. 6 is a rear view of the present invention showing the electronic control 138 and a battery 140, and displayed with the toilet lid 122 in the automated raised position with the lid bracket cap 136 installed on the lid bracket 132 thereby preventing the actuating arm 112 from sliding forward through the lid bracket 132 and therein, facilitating the automated operation of the toilet lid 122 and toilet seat 124 by the linear actuator 110.

The rear bracket 120 anchors the linear actuator 110, the toilet lid 122, the toilet seat 124, the electronic control 138 and the battery 140 to a conventional toilet bowl (not shown) using standard toilet lid and toilet seat mounting holes. The rear bracket 120, the toilet lid 122 and the toilet seat 124 can also be mounted to a toilet bowl separately.

Figure 7:
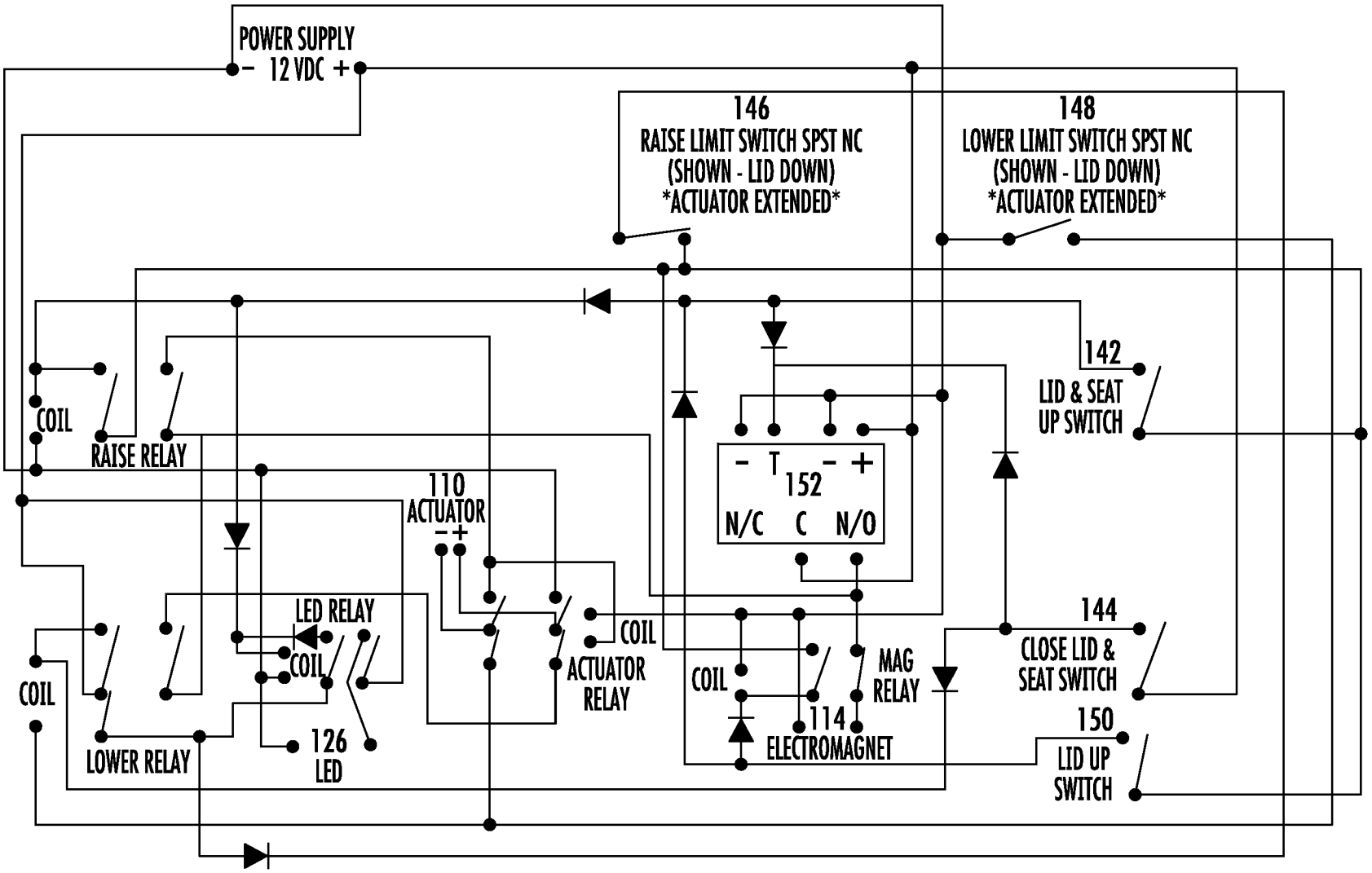
FIG. 7 outlines an embodiment of the control circuit schematic.

FIG. 7 depicts a schematic of the control circuit of one embodiment of the present invention consisting of five (5) DPDT (double pole double throw) relays, nine (9) diodes, two (2) NC (normally closed) SPST (single pole single throw) momentary limit switches, three (3) NO (normally open) SPST (single pole single throw) momentary switches and an off delay timer circuit 152. Remote controlled relays or motion sensors or any other method capable of accomplishing the task can also be used to facilitate the operation of the three momentary switches used in this schematic.

Electrical power for the linear actuator 110 and electromagnet 114 is derived from the off delay timer circuit 152 whereby the off delay timer circuit 152 functions as a safety feature to prevent the linear actuator 110 from being damaged by a failure of a raise limit switch 146 or a lower limit switch 148 by removing electrical power to the linear actuator 110 within three seconds, or any time sufficient to accomplish the task, beyond the predetermined time allotted for the linear actuator 110 to reach it's end of travel.

In addition, the off delay timer circuit 152 maintains electrical power to the electromagnet 114 for an additional three seconds, or any time sufficient to accomplish the task, after the linear actuator 110 has reached it's end of travel, wherein the off delay timer circuit 152 prevents the electromagnet 114 from being dislodged from the ferrous piece of metal 128 by the force of inertia encountered when the linear actuator 110 reaches it's end of travel.

When a lid up momentary switch 150 is activated, the linear actuator 110 and the LED 126 are energized. When the toilet lid 122 reaches the fully raised position, the linear actuator 110 is disabled by the raise limit switch 146, or the off delay timer circuit 152 if required, as the LED 126 remains energized. When the close lid and seat momentary switch 144 is activated, the LED 126 is disabled as the linear actuator 110 and the electromagnet 114 are energized. When the toilet lid 122 reaches the fully lowered position, the linear actuator 110 is disabled by the lower limit switch 148, or the off delay timer circuit 152 if required, and the electromagnet 114 is disabled by the off delay timer circuit 152.

When the lid and seat up momentary switch 142 is activated, the linear actuator 110, the electromagnet 114 and the LED 126, are all energized. When the toilet lid 122 and the toilet seat 124 both reach their fully raised position, the linear actuator 110 is disabled by the raise limit switch 146, or the off delay timer circuit 152 if required, and the electromagnet 114 is disabled by the off delay timer circuit 152, as the LED 126 remains energized.

When the close lid and seat momentary switch 144 is activated, the LED 126 is disabled as the linear actuator 110 and the electromagnet 114 are energized. When the toilet lid 122 and the toilet seat 124 reach their fully lowered position, the linear actuator 110 is disabled by the lower limit switch 148, or the off delay timer circuit 152 if required, and the electromagnet 114 is disabled by the off delay timer circuit 152.

The raise limit switch 146 and the lower limit switch 148 can be operated by cams, leavers, electronic sensors or any other method, connected to, or driven by, the movements of the linear actuator 110 or any component associated with the raising or lowering of the toilet lid 122 and or the toilet seat 124.

The invention claimed is:

1. An automated toilet lid and toilet seat actuating system comprising:

a linear actuator mounted to a rear bracket, and wherein the rear bracket is attached to a toilet bowl using standard toilet seat mounting holes;

a lid bracket, comprised of a greater and lesser bore, mounted to a toilet lid; and an adapter rod, comprised of a greater and lesser diameter, wherein the lesser diameter of the adapter rod is connected to an actuating arm of the linear actuator, and wherein the greater diameter of the adapter rod is housed within the greater diameter bore of the lid bracket;

and whereas, the system is capable of being actuated to raise said toilet lid.

2. The automated toilet lid and toilet seat actuating system of claim 1, wherein a lid bracket cap is sized to install over the lid bracket; wherein the front of the lid bracket cap is solid, and wherein the rear of the lid bracket cap is slotted, thereby allowing the actuating arm to enter the lesser bore of the lid bracket, whereas when the lid bracket cap is installed on the lid bracket, the actuating arm is prevented from passing through said lid bracket thereby facilitating the lowering of the toilet lid; and when the lid bracket cap is removed from the lid bracket, the actuating arm is allowed to pass through the lesser bore of the lid bracket, thereby facilitating the manual operation of said system.

3. The automated toilet lid and toilet seat actuating system of claim 1, wherein an electromagnet, mounted to said toilet lid, when electrically energized, electromagnetically affixes to a piece of ferrous metal, mounted to a toilet seat, thereby facilitating the raising and lowering of said toilet lid along with said toilet seat by said linear actuator.

4. The automated toilet lid and toilet seat actuating system of claim 1, wherein an off delay timer circuit maintains electricity to said electromagnet for a period of time after the actuating arm achieves full extension or full retraction.

* * * * *